US009677807B2

(12) United States Patent
Shin

(10) Patent No.: US 9,677,807 B2
(45) Date of Patent: Jun. 13, 2017

(54) REFRIGERATOR

(71) Applicant: LG ELECTRONICS INC., Seoul (KR)

(72) Inventor: Jungil Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/978,045

(22) Filed: Dec. 22, 2015

(65) Prior Publication Data

US 2016/0178274 A1 Jun. 23, 2016

(30) Foreign Application Priority Data

Dec. 23, 2014 (KR) ..... 10-2014-0187463

(51) Int. Cl.
*F25D 25/02* (2006.01)
*A47B 88/44* (2017.01)
*A47B 88/473* (2017.01)

(52) U.S. Cl.
CPC ..... *F25D 25/025* (2013.01); *A47B 88/44* (2017.01); *A47B 88/473* (2017.01)

(58) Field of Classification Search
CPC .... F25D 23/021; F25D 23/028; F25D 23/062; F25D 23/067; F25D 25/00; F25D 25/025; F25D 2325/00; F25D 2323/021; A47B 88/02; A47B 88/0411; A47B 2088/023; A47B 2088/026
See application file for complete search history.

(56) References Cited

U.S. PATENT DOCUMENTS 3,863,391 A * 2/1975 Horvay ..... E05D 7/1011 16/232
4,620,392 A * 11/1986 Kerpers ..... E05D 7/1011 16/229

(Continued)

FOREIGN PATENT DOCUMENTS

DE WO 2012025382 A2 * 3/2012 ..... A47B 88/0411
JP 2008-092984 A 4/2008

(Continued)

OTHER PUBLICATIONS

KR20140074520 Translated Description.pdf, 32 pages.*
Korean Office Action dated Dec. 11, 2015 for Korean Application No. 10-2014-0187463, 6 pages.

*Primary Examiner* — Andrew Roersma
(74) *Attorney, Agent, or Firm* — Fish & Richardson P.C.

(57) ABSTRACT

A refrigerator includes a cabinet defining a storage chamber, a first drawer slidably mounted within the storage chamber, the first drawer having a locking portion at an upper side of the first drawer and a recessed guide rail portion that is adjacent the locking portion and extended along a withdrawal direction of the first drawer, a second drawer slidably mounted within the storage chamber, a stopper provided at the second drawer, the stopper being configured to, based on the first drawer being withdrawn from the storage chamber, become locked to the locking portion, and the stopper being configured to, based on the first drawing being inserted into the storage chamber, be slidably accommodated in the guide rail portion such that the first and second drawers are independently movable relative to each other.

13 Claims, 9 Drawing Sheets

(56) References Cited

U.S. PATENT DOCUMENTS

| | | | | |
|---|---|---|---|---|
| 2010/0071404 | A1* | 3/2010 | Han | F25D 23/02 62/441 |
| 2010/0090574 | A1* | 4/2010 | Lim | F25D 25/025 312/404 |
| 2010/0219730 | A1* | 9/2010 | Watts | A47B 67/04 312/404 |
| 2011/0006656 | A1* | 1/2011 | Nam | A47B 88/12 312/404 |
| 2013/0241386 | A1* | 9/2013 | Kim | A47B 71/00 312/404 |
| 2013/0264928 | A1* | 10/2013 | Hong | F25D 25/025 312/404 |
| 2016/0209107 | A1* | 7/2016 | Choi | F25D 25/025 |

FOREIGN PATENT DOCUMENTS

| | | | | |
|---|---|---|---|---|
| JP | WO 2008117505 | A1 * | 10/2008 | F25D 17/065 |
| KR | 20-1988-0008339 | A1 | 6/1988 | |
| KR | 20-1991-0000164 | A1 | 1/1991 | |
| KR | 20-0169610 | Y1 | 3/2000 | |
| KR | 10-2014-0074520 | A | 6/2014 | |

* cited by examiner

REFRIGERATOR

CROSS-REFERENCE TO RELATED APPLICATION

Pursuant to 35 U.S.C. §119(a), this application claims the benefit of earlier filing date and right of priority to Korean Application No. 10-2014-0187463, filed on Dec. 23, 2014, the contents of which are incorporated by reference herein in its entirety.

FIELD

The present disclosure relates to a refrigerator, and more particularly, to a structure of a refrigerator capable of withdrawing an upper drawer together with a lower drawer when the lower drawer is withdrawn.

BACKGROUND

Generally, a refrigerator for storing food items at a low temperature serves to store food in a frozen state or a cooled state according to a state of the food.

Cool air supplied into the refrigerator may be generated by a heat exchange process of a refrigerant, and may be continuously supplied into the refrigerator as a cycle composed of compression-condensation-expansion-evaporation is repeatedly performed. Then, the supplied refrigerant can be uniformly transferred to the inside of the refrigerator by convection, thereby enabling food inside the refrigerator to be stored at a desired temperature.

Such a refrigerator may become large and multi-functional as dietary life is changed and a user's taste becomes varied. Further, the refrigerator may be implemented in various manners according to the desired configuration of a storage space.

A drawer for accommodating items such as vegetables may be moveably installed in the refrigerator. For movement of the drawer, a roller may be installed at a drawer body, and a guide portion for moving the roller may be formed on an inner wall of the refrigerator.

For a user's convenience, the drawer may be divided into an upper part and a lower part, and the upper and lower parts of the drawer maybe utilizable as individual spaces. For instance, a front upper drawer may be installed at an upper part of a storage chamber, and a front lower drawer may be installed at a lower part of the storage chamber.

In the conventional refrigerator having such front upper and lower drawers, a guide portion disposed on two side surfaces of the front upper drawer can have a roller structure. This may cause a withdrawal distance of the front upper drawer to be short. As a result, a user may have difficulty in obtaining a large storage space for accommodating items to be stored therein.

If the roller structure of the guide portion disposed on two side surfaces of the front upper drawer is changed into a slide rail structure for a long withdrawal distance, there may be a limitation in moving the drawer in a vertical direction.

SUMMARY

According to one aspect, a refrigerator includes a cabinet defining a storage chamber, a first drawer slidably mounted within the storage chamber, the first drawer having a locking portion at an upper side of the first drawer and a recessed guide rail portion that is adjacent the locking portion and extended along a withdrawal direction of the first drawer, a second drawer slidably mounted within the storage chamber, a stopper provided at the second drawer, the stopper being configured to, based on the first drawer being withdrawn from the storage chamber, become locked to the locking portion, and the stopper being configured to, based on the first drawing being inserted into the storage chamber, be slidably accommodated in the guide rail portion such that the first and second drawers are independently movable relative to each other, a first rail member provided at the cabinet and configured to slidably couple to the first drawer, a second rail member provided between the second drawer and the cabinet, and an elastic member provided above the stopper. The stopper includes a first side having a round shape that is configured to, based on the first drawing being inserted into the storage chamber, move upward by being pressed by the locking portion, and a second side that is opposite the first side and vertically oriented so as to be pressed by the locking portion based on the first drawer being withdrawn, such that the second drawer is withdrawn together with the first drawer. The locking portion includes an inclined portion configured to move the stopper upward by pressing the first side of the stopper based on the first drawer being inserted into is the storage chamber, and a stepped portion configured to press against the second side of the stopper based on the first drawer being withdrawn such that the second drawer is withdrawn together with the first drawer.

Implementations according to this aspect may include one or more of the following features. For example, the locking portion may be provided at two upper ends of the first drawer toward an upper side, and the stopper may be provided at two lower ends of the second drawer. The guide rail portion may be recessed from two upper parts of the first drawer along a direction parallel to a withdrawal direction of the second drawer, and the guide rail portion may be spaced from the stopper to accommodate therein part of the stopper such that the first and second drawers are moveable independently from each other based on the first drawer being inserted during assembly, or based on the first drawer being inserted into the storage chamber after the first and second drawers have been withdrawn.

In some cases, a stopper accommodation portion may be provided at two lower ends of the second drawer, the stopper accommodation portion being configured to accommodate the stopper therein such that the stopper is moveable therein in a vertical direction, and the stopper may be installed in the stopper accommodation portion such that part thereof is exposed to the outside. A slot hole may be defined in a vertical direction on one surface of the stopper accommodation portion, the slot hole being configured to restrict an up-down movement of the stopper, and the stopper may include a body portion having a plurality of surfaces that at least partially contact an inner side surface of the stopper accommodation portion. One surface of the body portion may include a protrusion that is configured to be inserted into and guided by the slot hole, and the protrusion may be configured to prevent separation of the stopper from the stopper accommodation portion based on the movement of the protrusion toward a lower side of the slot hole being restricted.

In some implementations, a stopper moving portion may be provided on one surface of the body portion, the stopper moving portion being configured to allow the first drawer to be separated from the storage chamber by releasing a locked state of the stopper by the locking portion, and the stopper moving portion may be configured to pass through the slot hole so as to force the stopper to move upward. A plurality of elastic member mounting portions may protrude upward from regions adjacent to corners of an upper surface of the body portion, and the elastic member may be provided in plurality, and the plurality of elastic members are provided at the elastic member mounting portions. Additionally, a pair of elastic member mounting portions are provided near diagonal corners of the upper surface of the body portion, and a pair of elastic members may be correspondingly provided at the pair of elastic member mounting portions. A plurality of cut-out portions may be formed on one surface of the body portion in a vertical direction, so as to be spaced from the protrusion, and part between the cut-out portions on one surface of the body portion may be configured to be elastically transformed such that interference between the protrusion and one surface of the stopper accommodation portion is restricted when the stopper is accommodated in the stopper accommodation portion.

DETAILED DESCRIPTION

Description will now be given in detail according to exemplary implementations disclosed herein, with reference to the accompanying drawings. For the sake of brief description with reference to the drawings, the same or equivalent components may be provided with the same or similar reference numbers, and description thereof will not be repeated. A singular representation may include a plural representation unless it represents a definitely different meaning from the context.

Figure 1:
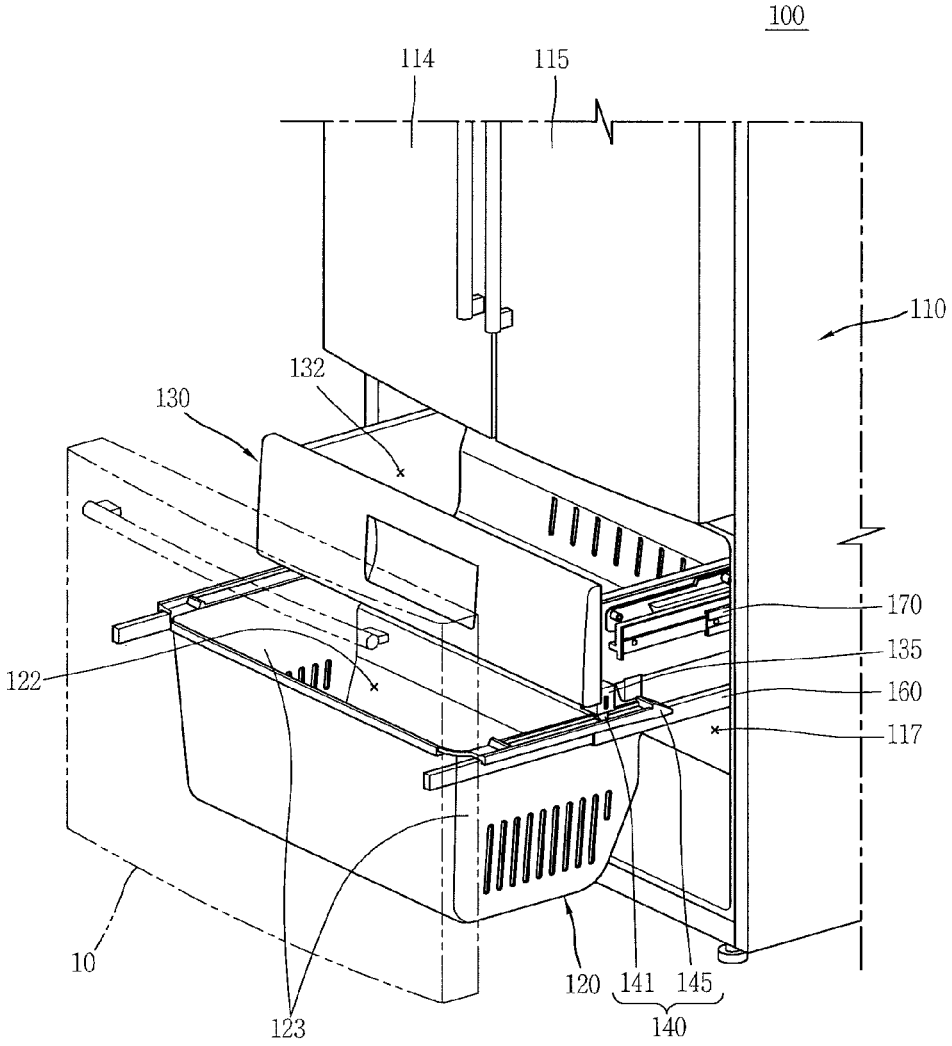
FIG. 1 is a perspective view of an example refrigerator.
Figure 2:
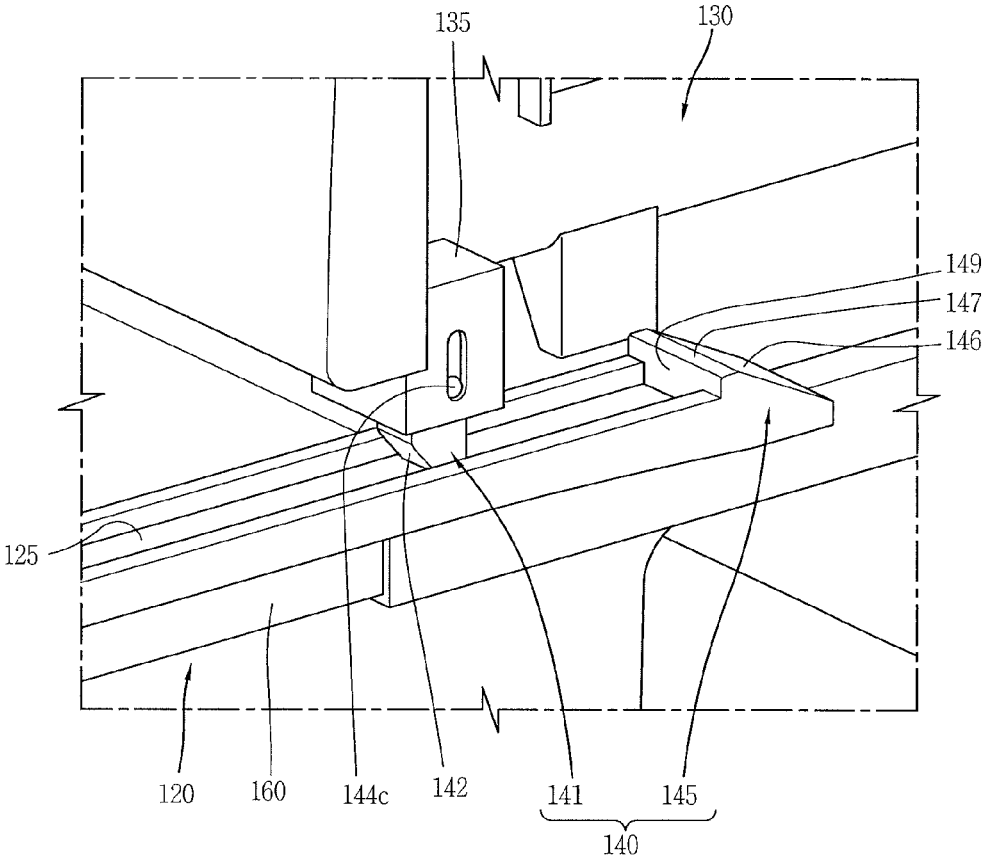
FIG. 2 is a perspective view of an example withdrawing unit of the refrigerator shown in FIG. 1.
Figure 3:
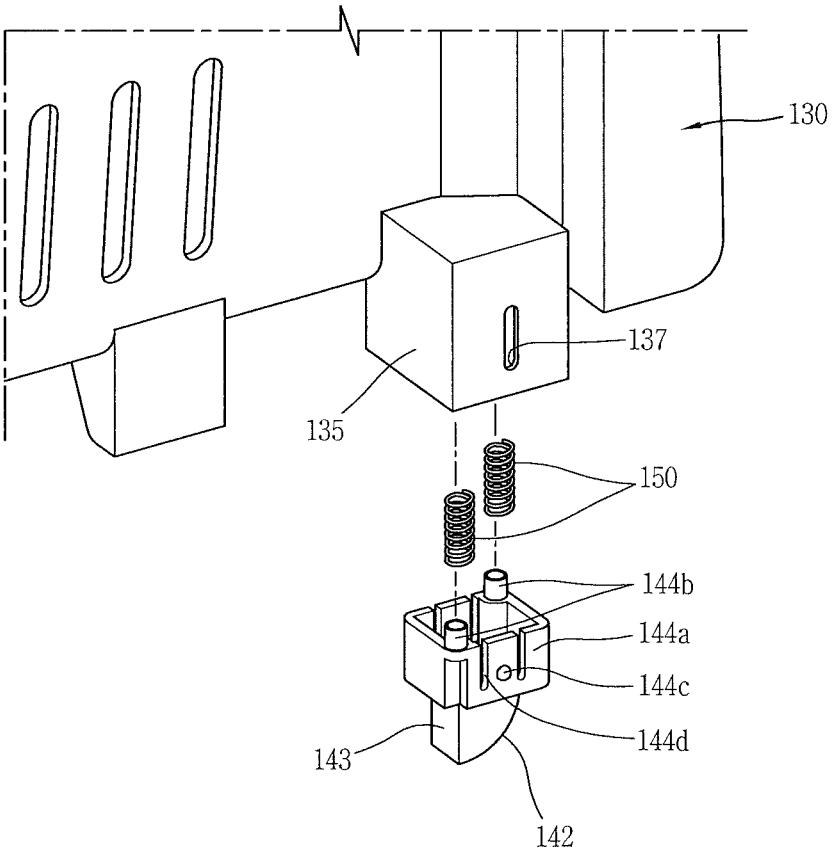
FIG. 3 is an exploded perspective view showing a stopper and a stopper receiving unit of the refrigerator shown in FIG. 1.

FIG. 1 is a perspective view of an example refrigerator, FIG. 2 is a perspective view of an example withdrawing unit of FIG. 1, and FIG. 3 is an exploded perspective view showing examples of a stopper and a stopper receiving unit of FIG. 1.

Referring to FIGS. 1 to 3, a refrigerator 100 includes a cabinet 110, a first drawer 120, a second drawer 130, a first rail member 160, a second rail member 170, and a withdrawing unit 140.

The cabinet 110 may be provided with a storage space therein for storing food items. The storage space may be divided by a partition wall, and may be divided into a refrigerating chamber and a freezing chamber according to a preset temperature.

A first door 114 and a second door 115 may be connected to the cabinet 110, and the first door 114 and the second door 115 are configured to open and close an opening of a front surface of the cabinet 110. In the drawings, the first door 114 and the second door 115 are shown configured to open and close a front surface of a refrigerating chamber and a front surface of a freezing chamber, respectively.

The first door 114 and the second door 115 may be configured in various manners. For instance, the first door 114 and the second door 115 may be configured as a rotation type door rotatably connected to the cabinet 110, a drawer type door slidably connected to the cabinet 110, etc.

The first drawer 120, the second drawer 130, etc. may be provided at the cabinet 110 so as to effectively utilize the storage space. And the first drawer 120 and the second drawer 130 may be installed at a storage chamber 117 in a withdrawable manner.

The storage chamber 117, where the first drawer 120 and the second drawer 130 are installed in a withdrawable manner, may be open and closed by a storage chamber door 10. For instance, the storage chamber door 10 may be installed at the storage chamber 117 so as to be opened and closed by the first rail member 160.

The first and second drawers 120, 130 may be provided with accommodation spaces 122, 132 for accommodating an object to be stored, respectively, and may be installed at the storage chamber 117 in a withdrawable manner, thereby allowing the storage chamber 117 to be utilized effectively. The object to be stored may be, for example, vegetables or fruits.

The first drawer 120 may be coupled to the storage chamber door 10, and may be moved together with the storage chamber door 10. The storage chamber door 10 may be coupled to the storage chamber 117 so as to be moveable by the first rail member 160. The first rail member 160 may have a three-stage rail structure, thereby sufficiently obtaining a withdrawal distance of the first drawer 120 and the storage chamber door 10. For instance, the first drawer 120 may be withdrawn when the storage chamber door 10 is open, and the first drawer 120 may be inserted when the storage chamber door 10 is closed.

The first drawer 120 may be provided with two side walls 123, and a guide rail portion 125 and a locking portion 145 may be formed at an upper end of the two side walls 123.

The second drawer 130 may be disposed above the first drawer 120, and may be installed at the storage chamber 117 in a withdrawable manner. The second rail member 170 may be installed between the second drawer 130 and the cabinet 110, thereby allowing a longer withdrawal distance of the second drawer 130 to be obtained.

Even if a withdrawal distance of the second drawer 130 may be sufficiently obtained by the second rail member 170, it may be difficult to move the second drawer 130 in a vertical direction. In this case, the first drawer 120 may be installed below the second drawer 130 without any interference or damage, due to the presence of a stopper 141 and the locking portion 145, as explained further below.

The guide rail portion 125 and the locking portion 145 may be formed on the first rail member 160 for opening and closing the storage chamber door 10, in a contacting manner so as to be moveable.

The guide rail portion 125 may be recessed in a direction parallel to a withdrawal direction of the second drawer 130. The guide rail portion 125 may be spaced from the stopper 141, as will be explained later, thereby accommodating therein part of the stopper 141.

When the first drawer 120 is to be installed, or when the first drawer 120 is to be inserted after both of the first and second drawers 120, 130 have been withdrawn, the first and second drawers 120, 130 can be moved independently. In this case, the guide rail portion 125 allows the first drawer 120 to move without any interference with the stopper 141. This may prevent damage of the first drawer 120 and the stopper 141.

The withdrawing unit 140 may be configured to withdraw the second drawer 130 together with the first drawer 120, after a time point when at least part of an accommodation space 122 of the first drawer 120 which has been withdrawn is exposed to the outside (hereinafter, will be referred to as the "time point"). Further, the withdrawing unit 140 may be configured to allow the first drawer 120 to be installed in the storage chamber 117 without any interference with the second drawer 130 and without damage.

The withdrawing unit 140 may include the locking portion 145, the stopper 141, and an elastic member 150.

The locking portion 145 may be formed at two upper ends of the first drawer 120 toward the second drawer 130. Preferably, the locking portion 145 may be formed at corners of two upper ends of the first drawer 120, in a direction to insert the first drawer 120 into the storage chamber 117, such that an inclined portion 146 of the locking portion 145 presses the stopper 141 in a contacting manner when the first drawer 120 is installed.

That is, the locking portion 145 may be formed at corners of two upper ends of the first drawer 120, which are distant from the storage chamber door 10. In this case, a withdrawal distance of the first drawer 120 that is obtained may be greater than in a case where the locking portion 145 is formed at middle parts of the two upper ends of the first drawer 120, or in a case where the locking portion 145 is formed at corners of the two upper ends of the first drawer 120 which are close to the storage chamber door 10.

The locking portion 145 may be configured to move the stopper 141 upward when the first drawer 120 is installed, and to withdraw the second drawer 130 from the storage chamber 117 by pressing the stopper 141 in a contacting manner when the second drawer 130 is withdrawn together with the withdrawn first drawer 120. The locking portion 145 may include an inclined portion 146, a horizontal portion 147 and a stepped portion 149.

In some cases, the locking portion 145 may have a shape similar to a right-angled triangle, and the upper end of the two side walls 123 of the first drawer 120 including the guide rail portion 125 and the locking portion 145 may have the same shape as an arrow indicating the storage chamber 117.

The inclined portion 146 can enable installation of the first drawer 120 by upward moving the stopper 141 by pressing a first part 142 of the stopper 141 in a contacting manner. The inclined portion 146 may be formed to have an inclined surface or an inclined curved surface. The inclined portion 146 may be formed to have various shapes to press the first part 142 in a contacting manner.

The horizontal portion 147 indicates a surface parallel to a ground surface between the inclined portion 146 and the stepped portion 149 to be explained later.

The stepped portion 149 can serve to withdraw the second drawer 130 together with the withdrawn first drawer 120, by pressing a second part 143 of the stopper 141 in a contacting manner, after a time point when at least part of the accommodation space 122 of the first drawer 120 which has been withdrawn is exposed to the outside. The stepped portion 149 should have a shape that is able to press the second part 143 of the stopper 141. For instance, the stepped portion 149 may be perpendicular to a ground surface.

The stopper 141 may be installed at the second drawer 130, and may be formed to be locked by the locking portion 145 after the time point. For instance, the stopper 141 may be installed at two lower ends of the second drawer 130. In this case, the stopper 141 may be installed in a stopper accommodation portion 135 such that part thereof may be exposed to the outside.

The stopper accommodation portion 135 may be formed to accommodate therein part of the stopper 141, and to enclose part of the stopper 141 so as to guide an up-down movement of the stopper 141.

The stopper accommodation portion 135 may be provided with a slot hole 137 formed in a vertical direction, on one surface thereof. As a protrusion **144*c* of the stopper 141 to be explained later is inserted into the slot hole 137, an up-down movement of the stopper 141 may be restricted by the slot hole 137, and separation of the stopper 141 from the stopper accommodation portion 135** may be prevented or mitigated.

The stopper 141 may include the first part 142, the second part 143, a body portion **144*a*, and an elastic member mounting portion 144*b***.

The first part 142 may be formed to be rounded so as to move the stopper 141 upward by pressing the inclined portion 146 in a contacting manner when the first drawer 120 is installed. For instance, the first part 142 may be connected to a bottom surface of the stopper 141 in a state where one side surface thereof has a curved surface.

The second part 143 may be formed in a vertical direction on an opposite side to the first part 142, such that the second drawer 130 is withdrawn to be pressed by the stepped portion 149 in a contacting manner, when the first drawer 120 is withdrawn after the time point. For instance, the second part 143 may be a surface formed in a vertical direction on an opposite side to the one side surface.

The body portion **144*a* may be formed to contact the inside of the stopper accommodation portion 135, such that the stopper 141 is accommodated in the stopper accommodation portion 135 so as to be moveable. That is, the body portion 144*a* may be provided with a plurality of surfaces so as to contact an inner side surface of the stopper accommodation portion 135** at least partially.

The protrusion **144*c* may be formed at the body portion 144*a* so as to be inserted into the slot hole 137 of the stopper accommodation portion 135. The protrusion 144*c* allows the stopper 141 to move in a vertical direction within the stopper accommodation portion 135 and prevents separation of the stopper 141 from the stopper accommodation portion 135, by being guided in the slot hole 137**.

A plurality of cut-out portions **144*d* may be formed on one surface of the body portion 144*a* in a vertical direction, so as to be spaced from the protrusion 144*c*. Part between the cut-out portions 144*d* on one surface of the body portion 144*a* may be elastically transformed, such that interference between the protrusion 144*c* and one surface of the stopper accommodation portion 135 is prevented when the stopper is accommodated in the stopper accommodation portion 135**.

The elastic member mounting portion **144*b* may protrude from an upper part of the stopper 141 so as to mount the elastic member 150 therein. The elastic member mounting portion 144*b* may protrude upward from a region adjacent to a corner of an upper surface of the body portion 144*a*. For instance, the elastic member mounting portion 144***b* may be formed in two, near diagonal corners of the upper surface of the body portion 144*a*.

The elastic member 150 may be further installed between an upper end of the stopper 141 and the stopper accommodation portion 135. For instance, the elastic member 150 may be installed in a vertical direction, at the elastic member mounting portion 144*b* disposed at an upper end of the stopper 141. The elastic member 150 may be configured to be compressed when the stopper 141 is moved upward, and to be extended when the stopper 141 returns to the original position.

The elastic member 150 should have a proper strength such that the first drawer 120 is smoothly moved into the storage chamber 117 as the inclined portion 146 of the locking portion 145 presses the first part 142 of the stopper 141 in a contacting manner. The elastic member 150 may be installed at the elastic member mounting portion 144*b*, and may enable the stopper 141 of the locking portion 145 to be upward moveable when the first drawer 120 is assembled with the storage chamber 117.

The elastic member 150 may be provided in plurality, and may be installed in plurality at the elastic member mounting portions 144*b*. For instance, the elastic member 150 may be installed in plurality, at the elastic member mounting portions 144*b* which are near diagonal corners of the upper surface of the body portion 144*a*.

Such a structure where the elastic member 150 having a relatively small size is installed in plurality may be advantageous in withstanding a non-uniform load applied to the upper side of the stopper 141 when the stopper 141 is moved upward by a lateral force, e.g., when the inclined portion 146 of the first drawer 120 presses the second part 143 of the stopper 141.

Hereinafter, an operation of the first and second drawers 120, 130 will be explained in more detail with reference to FIGS. 4 to 6.

Figure 4:
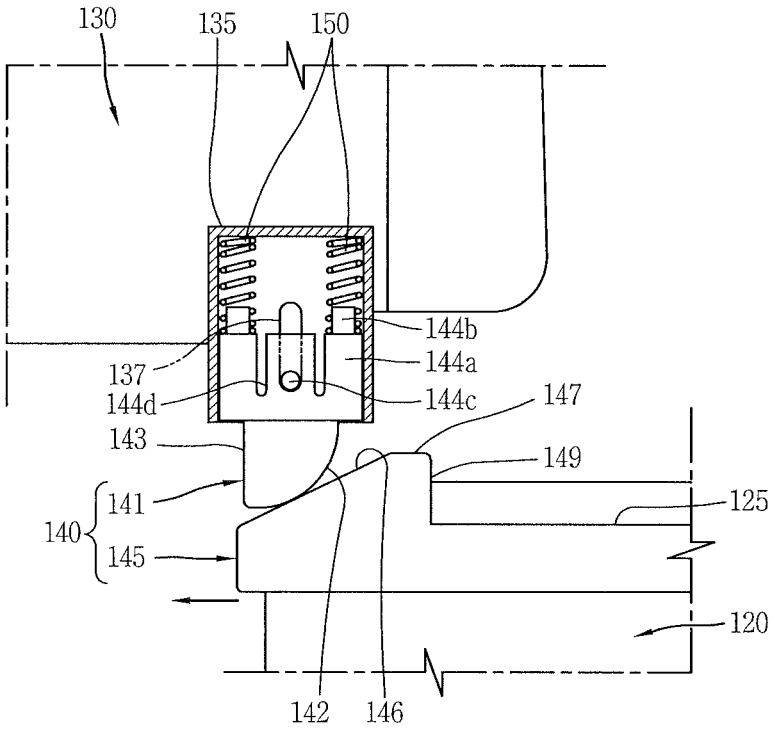
FIG. 4 is a conceptual view illustrating an example configuration of a locking portion and a stopper coming in contact with each other when a first drawer is installed.
Figure 5:
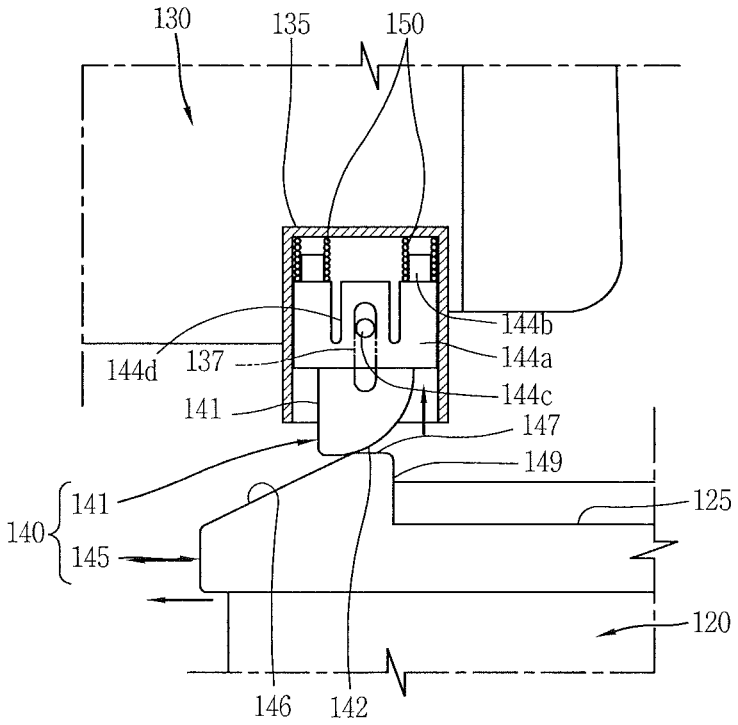
FIG. 5 is a conceptual view illustrating an upward movement of a stopper by a locking portion when a first drawer is installed.

FIGS. 4 and 5 show an operation of the refrigerator when the first drawer 120 is installed. Installing the first drawer 120 can include assembling the first drawer 120 with the storage chamber 117 when manufacturing the refrigerator 100, or assembling the first drawer 120 with the storage chamber 117 after withdrawing the first drawer 120 from the storage chamber 117 for cleaning at home, etc.

FIG. 4 illustrates an example operation of the locking portion 145 and the stopper 141 of the withdrawing unit 140. More specifically, FIG. 4 illustrates an operation to press the first part 142 as the inclined portion 146 of the locking portion 145 comes in contact with the first part 142 of the stopper 141.

FIG. 5 illustrates an example state where the first drawer 120 has been further moved into the storage chamber 117. In this case, as the inclined portion 146 presses the first part 142 more, the stopper 141 is in an upward-moved state. The elastic member 150 is in a compressed state to store elastic energy therein. The first part 142 is in a state before contacting the horizontal portion 147.

The inclined portion 146 of the locking portion 145 upward-moves the stopper 141 by pressing the first part 142 of the stopper 141 in a contacting manner, thereby having a minimized interference or collision with the stopper 141.

The guide rail portion 125 of the first drawer 120 may be spaced from the stopper 141, and may enable the first drawer 120 to be inserted into the storage chamber 117 with accommodating part of the stopper 141. Thus, the first drawer 120 may be installed at the storage chamber 117 without any interference or collision with the stopper 141.

Figure 6:
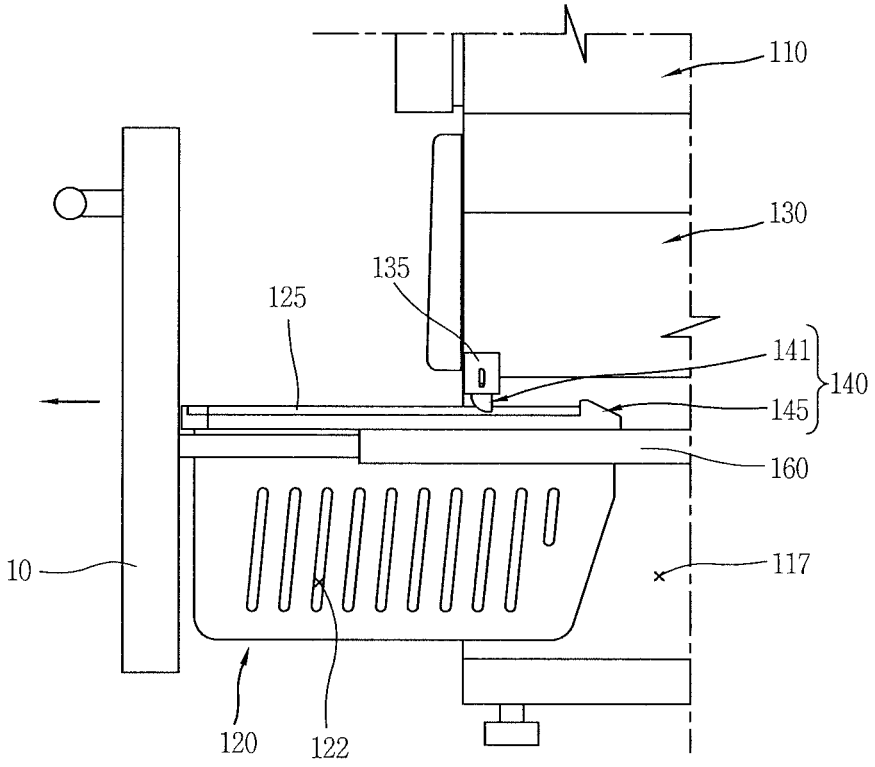
FIG. 6 is a conceptual view illustrating an example process to withdraw a first drawer after installation.

FIG. 6 is a conceptual view that illustrates withdrawing the first drawer which has been installed.

Referring to FIG. 6, after the first drawer 120 is installed at the storage chamber 117, a user can open the storage chamber door 10 in order to withdraw the first drawer 120. As aforementioned, the storage chamber door 10 is connected to the cabinet 110 for accommodating the storage chamber 117 therein by the first rail member 160, and the storage chamber door 10 and the first drawer 120 are coupled to each other.

The first drawer is withdrawn independently from the second drawer, before the second drawer 130 starts to be withdrawn together with the withdrawn first drawer 120. The guide rail portion 125 is spaced from the stopper 141, and is withdrawn with receiving part of the stopper 141. Thus, the first drawer 120 can be withdrawn independently without any interference or collision with the stopper 141.

Figure 7:
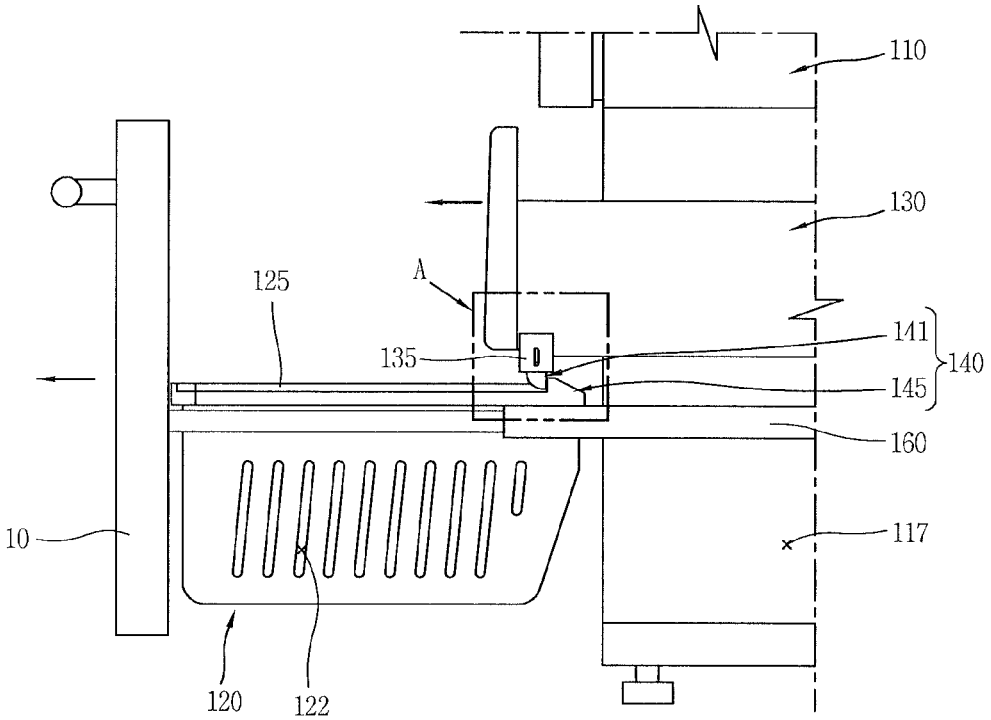
FIG. 7 is a conceptual view illustrating an example process to withdraw a second drawer by withdrawal of a first drawer.
Figure 8:
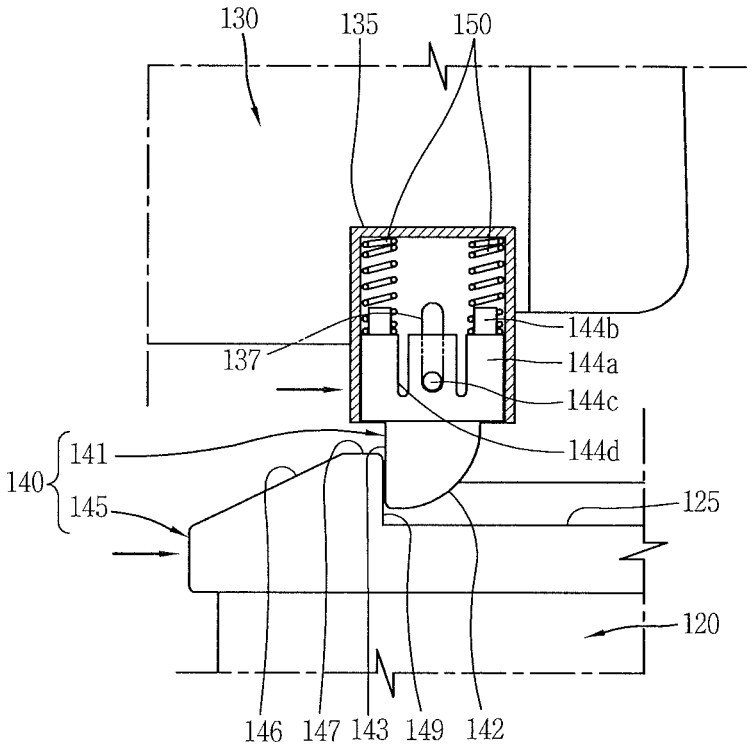
FIG. 8 is an enlarged view of part A in FIG. 7.

Referring to FIGS. 7 and 8, a process of withdrawing the second drawer 130 together with the first drawer 120 will be explained in further detail.

After the aforementioned time point, i.e., the time point when the first drawer 120 is withdrawn and at least part of the accommodation space 122 is exposed to the outside as the storage chamber door 10 is open, the stepped portion 149 of the locking portion 145 starts to press the second part 143 of the stopper 141 in a contacting manner.

Then, the second drawer 130 is withdrawn together with the first drawer 120 in a direction indicated by the arrows. In this case, the stepped portion 149 of the locking portion 145 presses the second part 143 of the stopper 141 in a contacting manner, thereby withdrawing the second drawer 130 together with the first drawer 120.

The direction of the arrow indicates a withdrawal direction of the first drawer 120 and the second drawer 130.

As aforementioned, the rail member 160 may be installed between the storage chamber door 10 and the cabinet 110 for accommodating the storage chamber 117 therein, and the rail member 170 may be installed between the second drawer 130 and the cabinet 110. With such a configuration, a sufficient withdrawal distance of each of the first and second drawers 120, 130 may be obtained.

Figure 9:
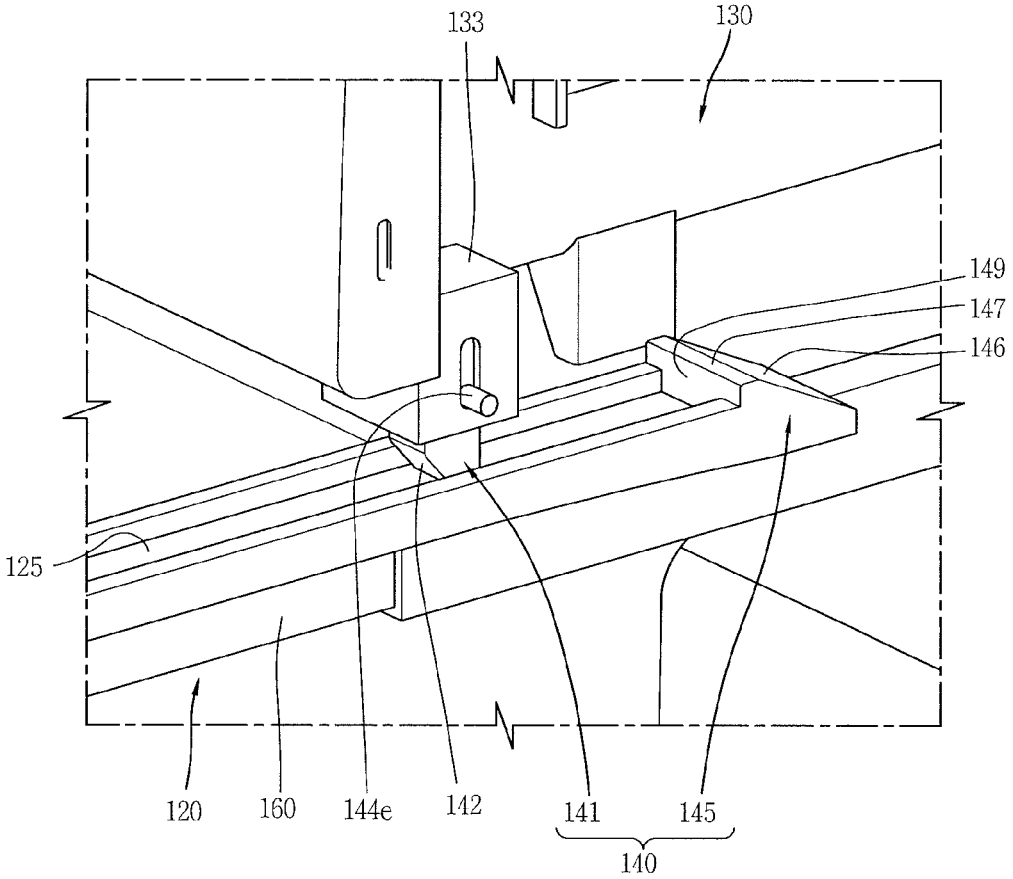
FIG. 9 is a perspective view of another example withdrawing unit of a refrigerator.

FIG. 9 is a perspective view showing an alternative implementation of the withdrawing unit 140.

Referring to FIG. 9, a stopper moving portion 144*e* for moving the stopper 141 so as to pass through the slot hole 137 of the stopper accommodation portion 135 may be installed on one surface of the stopper 141. The stopper moving portion 144*e* protrudes out by passing through the slot hole 137 for a user's manual operation. The stopper moving portion 144*e* may be integrally formed with the body portion 144*a* of the stopper 141, or may be implemented as an additional member.

The stopper moving portion 144*e* enables the first drawer 120 to be separated from the storage chamber 117 without any collision or interference between the locking portion 145 and the stopper 141, by upward-moving the stopper 141 in a forcible manner. A user may wash or repair the first drawer 120 after separating the first drawer 120 from the storage chamber 117.

As the present features may be implemented in several forms without departing from the characteristics thereof, it should also be understood that the above-described implementations are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator, comprising:

a cabinet defining a storage chamber;

a first drawer slidably mounted within the storage chamber, the first drawer having a locking portion at an upper side of the first drawer and a recessed guide rail portion that is adjacent the locking portion and extended along a withdrawal direction of the first drawer;

a second drawer slidably mounted within the storage chamber;

a stopper provided at the second drawer, the stopper being configured to, based on the first drawer being withdrawn from the storage chamber, become locked to the locking portion, and the stopper being configured to, based on the first drawer being inserted into the storage chamber, be slidably accommodated in the guide rail portion such that the first and second drawers are independently movable relative to each other;

a first rail member provided at the cabinet and configured to slidably couple to the first drawer;

a second rail member provided between the second drawer and the cabinet; and a pair of elastic members provided at opposing diagonal corners above the stopper and configured to provide an elastic force to the stopper, wherein the stopper includes:

a first side having a round shape that is configured to, based on the first drawer being inserted into the storage chamber, move upward by being pressed by the locking portion, and a second side having a flat surface that is opposite the first side and vertically oriented so as to be pressed by the locking portion based on the first drawer being withdrawn, such that the second drawer is withdrawn together with the first drawer, and wherein the locking portion includes:

an inclined portion configured to move the stopper upward by pressing the first side of the stopper based on the first drawer being inserted into the storage chamber, and a stepped portion configured to press against the second side of the stopper based on the first drawer being withdrawn such that the second drawer is withdrawn together with the first drawer.

2. The refrigerator of claim 1, wherein the locking portion is provided at two upper ends of the first drawer toward an upper side, and wherein the stopper is provided at two lower ends of the second drawer.

3. The refrigerator of claim 2, wherein a stopper accommodation portion is provided at two lower ends of the second drawer, the stopper accommodation portion being configured to accommodate the stopper therein such that the stopper is moveable therein in a vertical direction, and wherein the stopper is installed in the stopper accommodation portion such that part thereof is exposed to the outside.

4. The refrigerator of claim 3, wherein a slot hole is defined in a vertical direction on one surface of the stopper accommodation portion, the slot hole being configured to restrict an up-down movement of the stopper, and wherein the stopper includes a body portion having a plurality of surfaces that at least partially contact an inner side surface of the stopper accommodation portion.

5. The refrigerator of claim 4, wherein one surface of the body portion includes a protrusion that is configured to be inserted into and guided by the slot hole, and wherein the protrusion is configured to prevent separation of the stopper from the stopper accommodation portion based on the movement of the protrusion toward a lower side of the slot hole being restricted.

6. The refrigerator of claim 5, wherein a plurality of cut-out portions are formed on one surface of the body portion in a vertical direction, so as to be spaced from the protrusion, and wherein part between the cut-out portions on one surface of the body portion is configured to be elastically transformed such that interference between the protrusion and one surface of the stopper accommodation portion is restricted based on the stopper being accommodated in the stopper accommodation portion.

7. The refrigerator of claim 5, wherein a plurality of elastic member mounting portions protrude upward from regions adjacent to corners of an upper surface of the body portion, and wherein the elastic member is provided in plurality, and the plurality of elastic members are provided at the elastic member mounting portions.

8. The refrigerator of claim 7, wherein a pair of elastic member mounting portions are provided near diagonal corners of the upper surface of the body portion, and wherein a pair of elastic members are correspondingly provided at the pair of elastic member mounting portions.

9. The refrigerator of claim 4, wherein a stopper moving portion is provided on one surface of the body portion, the stopper moving portion being configured to allow the first drawer to be separated from the storage chamber by releasing a locked state of the stopper by the locking portion, and wherein the stopper moving portion is configured to pass through the slot hole so as to force the stopper to move upward.

10. The refrigerator of claim 9, wherein a plurality of elastic member mounting portions protrude upward from regions adjacent to corners of an upper surface of the body portion, and wherein the elastic member is provided in plurality, and the plurality of elastic members are provided at the elastic member mounting portions.

11. The refrigerator of claim 10, wherein a pair of elastic member mounting portions are provided near diagonal corners of the upper surface of the body portion, and wherein a pair of elastic members are correspondingly provided at the pair of elastic member mounting portions.

12. The refrigerator of claim 1, wherein the guide rail portion is recessed from two upper parts of the first drawer along a direction parallel to a withdrawal direction of the second drawer, and wherein the guide rail portion is spaced from the stopper to accommodate therein part of the stopper such that the first and second drawers are moveable independently from each other based on the first drawer being inserted during assembly, or based on the first drawer being inserted into the storage chamber after the first and second drawers have been withdrawn.

13. The refrigerator of claim 1, wherein the flat surface of the second side of the stopper is oriented parallel to the stepped portion of the locking portion.

* * * * *